US006305726B1

(12) United States Patent
LeTrudet

(10) Patent No.: US 6,305,726 B1
(45) **Date of Patent: *Oct. 23, 2001**

(54) LATCH ASSEMBLY FOR COLLAPSIBLE STORAGE BIN

(75) Inventor: Stephane F. LeTrudet, St. Peters, MO (US)

(73) Assignee: Allibert-Contico, L.L.C., Bridgeton, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/977,161

(22) Filed: Nov. 24, 1997

(51) Int. Cl.[7] ..... E05C 1/10
(52) U.S. Cl. ..... 292/175; 292/162
(58) Field of Search ..... 292/89, DIG. 30, 292/DIG. 38, DIG. 31, DIG. 63, 145, 171, 175, 162, 163, 164

(56) References Cited

U.S. PATENT DOCUMENTS

| | | | | |
|---|---|---|---|---|
| 3,125,366 | * | 3/1964 | Cetrone | 292/169 |
| 3,671,065 | * | 6/1972 | Bingham | 292/175 |
| 3,825,289 | * | 7/1974 | Armstrong | 292/2 |
| 4,061,369 | * | 12/1977 | Palmer | 292/163 |
| 4,641,506 | * | 2/1987 | Boucher | 70/129 |
| 4,837,975 | * | 6/1989 | Simpson | 49/175 |
| 5,145,221 | * | 9/1992 | Pennebaker | 292/175 |
| 5,193,707 | * | 3/1993 | Mizumura | 220/326 |
| 5,823,583 | * | 10/1998 | Sandhu | 292/173 |
| 5,897,147 | * | 4/1999 | Alyanakian | 292/175 |

OTHER PUBLICATIONS

Exhibit A—Latch Assembly for bin known as "Ultimate Bin"; First manufactured and sold by Allibert–Contico, LLC in or around 1991.
Exhibit B—Latch, Component for bin; to Applicant's knowledge first manufactured and sold by Xytec in or around 1995.

* cited by examiner

*Primary Examiner*—Gary Estremsky
(74) *Attorney, Agent, or Firm*—Mattingly, Stanger & Malur, P.C.

(57) ABSTRACT

A latch assembly of the present invention is configured for latching a first wall member and a second wall member to one another. The latch assembly includes a base portion, a locking member and a spring member. One of the first and second wall members is moveable relative to the other. The base portion is fixed to the second wall portion. The locking member is movably connected to the base portion and is moveable relative to the base portion between a locked position and an unlocked position. The locking member is adapted to engage the first wall member in a manner to prevent relative movement between the first and second wall members when the locking member is in the locked position, and to permit relative movement between the first and second wall members when the locking member is in the unlocked position. The spring member is adapted for engaging the base portion and the locking member in a manner for urging the locking member toward the locked position. The spring member and one of the base portion and the locking member are of a monolithic piece.

A method of the present invention for making a latch assembly comprises the steps of forming a base portion, forming a locking member, and forming a spring member. The steps of forming the base portion and forming the spring member are performed substantially simultaneously.

17 Claims, 4 Drawing Sheets

LATCH ASSEMBLY FOR COLLAPSIBLE STORAGE BIN

BACKGROUND OF THE INVENTION

This invention relates generally to latch assemblies and, more particularly, to latch assemblies which are configured for locking a first wall member and a second wall member to one another to prevent relative movement between the first and second wall members.

The prior art is filled with myriad latch assemblies and locking assemblies, all of which serve the basic function of locking a first wall member and a second wall member to one another to prevent relative movement between the first and second wall members. Such assemblies are commonly used in storage containers, drawers, fences and doors of all kinds.

One such prior art latch assembly, which is employed in a collapsible storage bin, includes a base plate formed of a polymeric material, a locking piece formed of a polymeric material, and a pair of metal coil springs. The bin includes a bin bottom and four side walls extending upwardly from the bin bottom to form a bin interior. One of the side walls is pivotally moveable relative to the rest of the bin between open and closed positions. The base plate is fixed to the moveable side wall. The locking piece is slidably connected to the base plate for movement between locked and unlocked positions relative to the base plate. The locking piece and the base plate together define a pair of spring chambers when connected to one another. The two metal coil springs are positioned within the chambers to urge the locking member toward the locked position.

A problem with this prior art latch assembly is that the metal coil springs may tend to oxidize or corrode over time. Another problem is that the assembly is comprised of four separate components which are of at least two different materials, and which are most likely not all available from a single manufacturing source. Still another problem is that the assembly is somewhat difficult to assemble and disassemble.

SUMMARY OF THE INVENTION

It is an object of the present invention to provide a latch assembly which is comprised of components that are less susceptible to oxidation and corrosion. Another object is to provide a latch assembly which is comprised of fewer components than prior art latch assemblies. Still another object is to provide a latch assembly having components which are all of the same material, and which are available from a single manufacturing source. Yet another object is to provide a latch assembly which is designed for easier assembly and disassembly.

In general, a latch assembly of the present invention comprises a base portion, a locking member and a spring member. The latch assembly is configured for latching a first wall member and a second wall member to one another. One of the first and second wall members is moveable relative to the other. The base portion is fixed to the second wall portion. The locking member is movably connected to the base portion and is moveable relative to the base portion between a locked position and an unlocked position. The locking member is adapted to engage the first wall member in a manner to prevent relative movement between the first and second wall members when the locking member is in the locked position, and to permit relative movement between the first and second wall members when the locking member is in the unlocked position. The spring member is adapted for engaging the base portion and the locking member in a manner for urging the locking member toward the locked position. The spring member and one of the base portion and the locking member are of a monolithic piece.

A method of the present invention for making a latch assembly comprises the steps of forming a base portion, forming a locking member, and forming a spring member. The base member is formed for fixation to the second wall portion. The locking member is formed for moveable connection to the base portion so that it can move between a first position and a second position relative to the base portion. The spring member is formed for engagement with the base portion and the locking member in a manner for urging the locking member toward the locked position. The steps of forming the base portion and forming the spring member are performed substantially simultaneously.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
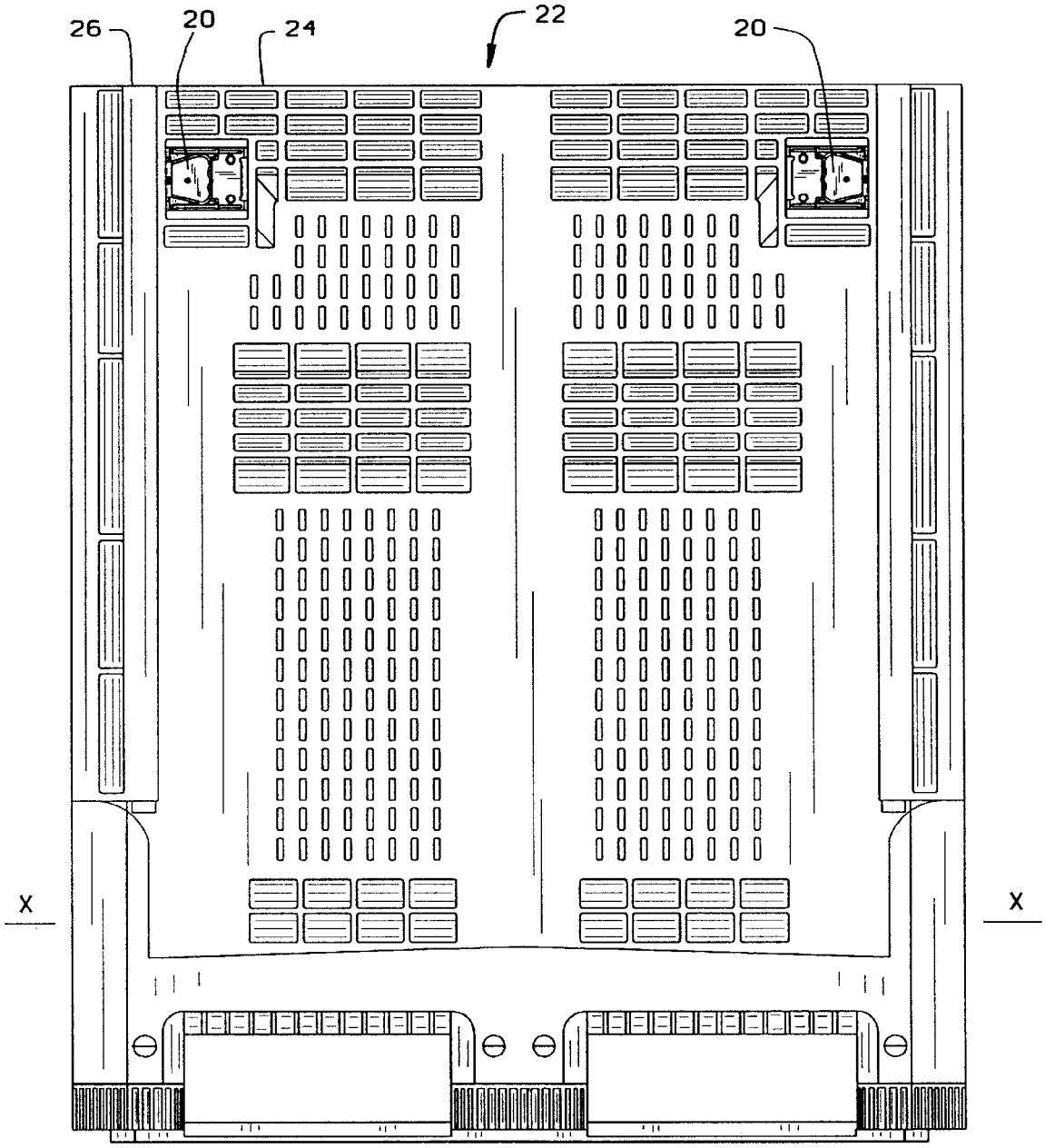
FIG. 1 is a side elevational view of a bin employing a latch assembly of the present invention.
Figure 3:
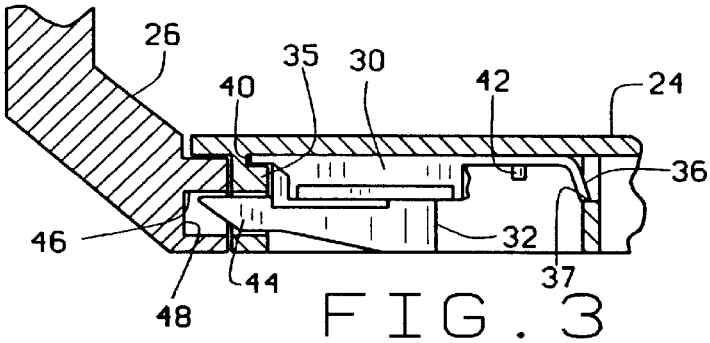
FIG. 3 is a fragmented, cross-sectional view taken along the plane of line 3—3 in FIG. 2 showing the latch assembly in a locked position.
Figure 4:
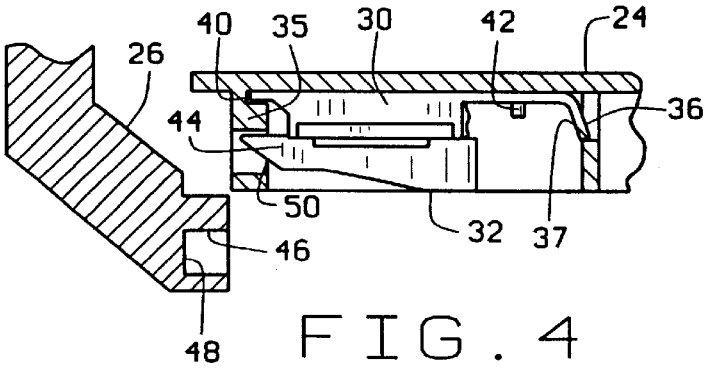
FIG. 4 is a fragmented, cross-sectional view similar to that of FIG. 3 but showing the latch assembly in an unlocked position.
Figure 5:
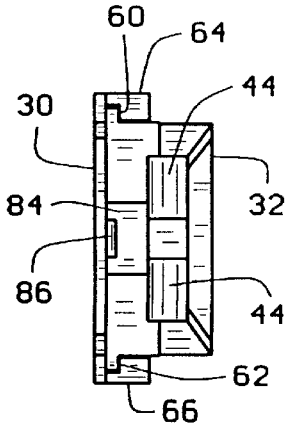
FIG. 5 is an end elevational view of the latch assembly of FIG. 1.

A latch assembly of the present invention is represented in its entirety by the reference numeral 20. FIG. 1 is a side elevational view of a storage bin, generally indicated at 22, which employs a plurality of the latch assemblies 20. Preferably, the bin 22 includes a bin bottom (not shown) and a plurality of walls extending upwardly from the bottom to define a bin interior. At least one of the walls is a moveable wall member 24 and at least one other of the walls is a stationary wall member 26. The moveable wall member 24 is pivotally moveable relative to the stationary wall member 26 about a pivot axis X between a closed position (FIGS. 1 through 3) and an open position (FIG. 4). In the preferred embodiment, the bin 22 includes two moveable wall members 24 positioned opposite one another, and two stationary wall members 26 positioned opposite one another. As shown in FIG. 1, in the preferred embodiment, two latch assemblies 20 are used with each moveable wall member 24.

Figure 2:
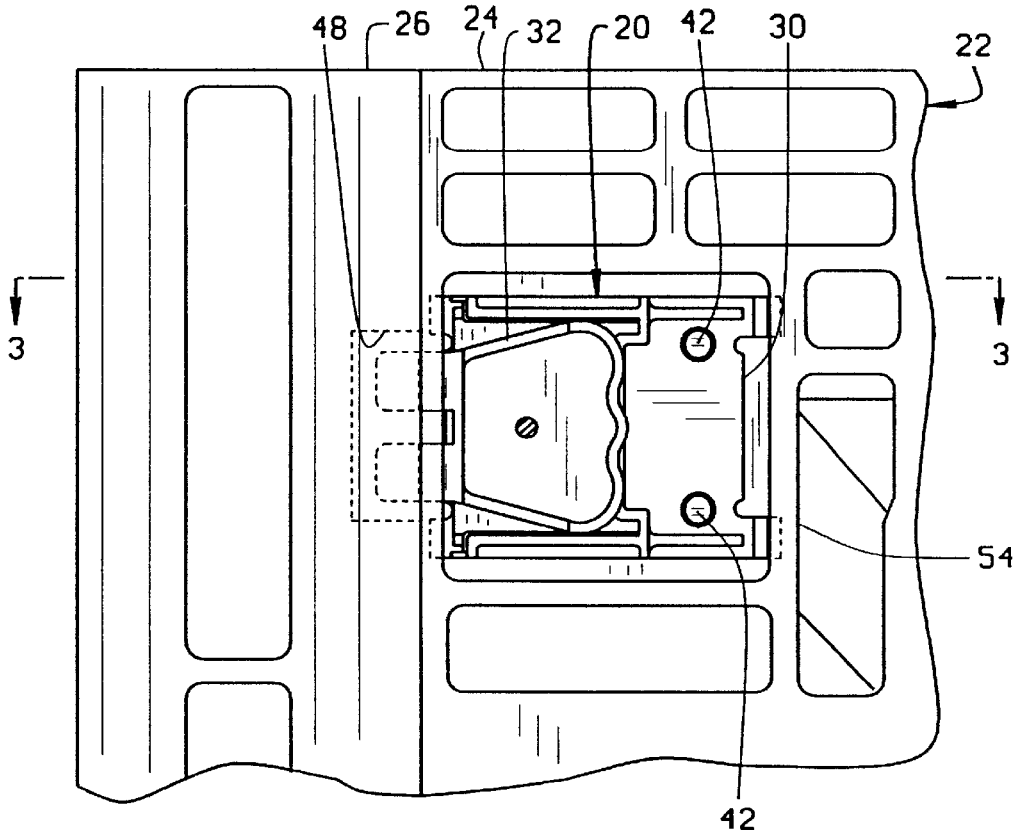
FIG. 2 is an enlarged, fragmented side elevational view of the bin and latch assembly of FIG. 1.

FIG. 2 is an enlarged, fragmented side elevational view of one of the latch assemblies 20 of FIG. 1. The latch assembly 20 is configured for latching the moveable wall member 24 and the stationary wall member 26 to one another. The latch assembly 20 comprises a base portion 30, a locking member 32 and a spring member 34. In the preferred embodiment, the base portion 30, locking member 32 and spring member 34 are injection molded from suitable polymeric materials, such as acetal. However, other materials could be used so long as they are sufficiently strong and durable.

As will be explained below in greater detail, the base portion is fixed to the moveable wall member 24 and the locking member 32 is movably connected to the base portion 30. The locking member 32 is engageable with the stationary wall member 26 in a manner to prevent relative movement between the moveable wall member 24 and stationary wall member 26 when the locking member 32 is in a locked position (FIG. 3), and to permit relative movement between the moveable wall member 24 and stationary wall member 26 when the locking member 32 is in an unlocked position (FIG. 4).

Figure 8:
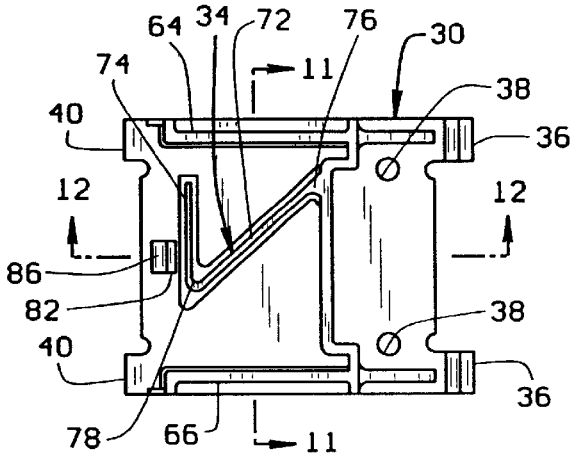
FIG. 8 is a front elevational view of the base portion, with the locking member removed to show detail.
Figure 9:
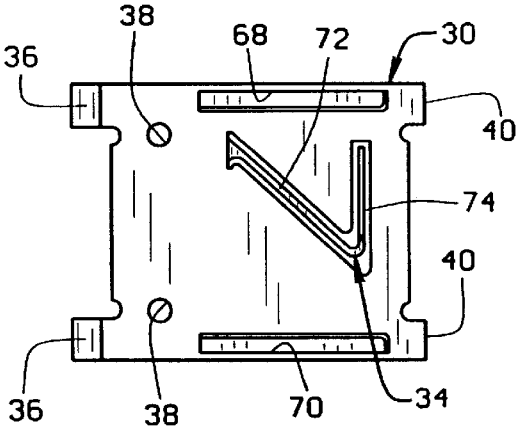
FIG. 9 is a back elevational view of the base portion.
Figure 11:
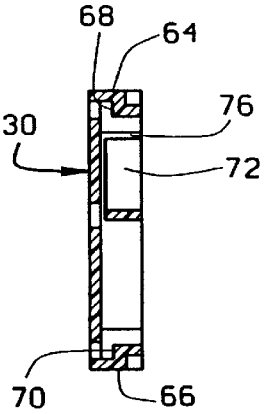
FIG. 11 is a cross-sectional view of the base portion taken along the plane of line 11—11 of FIG. 8.
Figure 10:
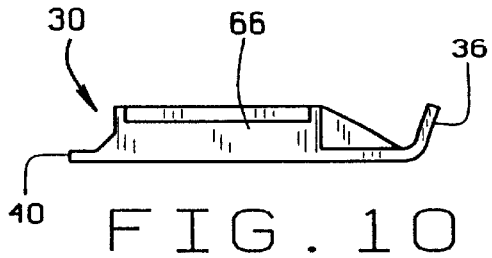
FIG. 10 is a bottom plan view of the base portion, with the locking member removed.
Figure 12:
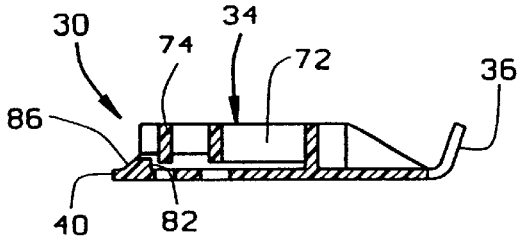
FIG. 12 is a cross-sectional view of the base portion taken along the plane of line 12—12 of FIG. 8.

The base portion 30 is shown in detail in FIGS. 6 through 12. As best shown in FIGS. 10 through 12, the base portion 30 preferably has a generally flat configuration. Angled tabs 36 and flat tabs 40 are provided for fixedly mounting the base portion 30 to the moveable wall member 24. As shown in FIGS. 3 and 4, the moveable wall member 24 includes an outwardly extending portion 35 which defines a recess sized to receive the flat tabs 40. The moveable wall member is also configured to define a second recess 37 which is sized to receive the angled tabs 36. The base portion 30 also preferably includes holes 38 sized to receive pins 42 which project outwardly from the moveable wall member 24 for preventing vertical movement of the base portion 30 relative to the moveable wall member 24. When mounting the base portion 30 to the moveable wall member 24, the flat tabs 40 are first inserted into recess that is defined by the outwardly extending portion 35. Then, the holes 38 are aligned with the pins 42 and the angled tabs 36 are moved toward the recess 37. As the angled tabs 36 are moved toward the recess 37, they are deflected (down and to the left as shown in FIGS. 3 and 4) by a portion of the moveable wall member 24 adjacent the recess 37 and, finally, the angled tabs 36 are snapped into engagement with the recess 37.

The locking member 32 is shown in detail in FIGS. 13 through 16. The locking member 32 includes at least one, and preferably two projections 44 which are adapted to engage a locking surface 46 of the stationary wall member 26 in a manner to prevent relative movement between the stationary wall member 26 and the moveable wall member 24 when the locking member 32 is in its locked position, and to permit relative movement between the moveable wall member 24 and stationary wall member 26 when the locking member 32 is in its unlocked position. Preferably, the locking surface 46 defines a portion of a notch 48 in the stationary wall member 26. The notch 48 is sized to receive the projections 44 of the locking member 32 when the locking member is in its locked position. As shown in FIGS. 3 and 4, each projection 44 includes a camming surface 50 configured for camming engagement with at least an outer edge of the stationary wall member 26. Engagement of the camming surface 50 with the outer edge of the stationary wall member 26 causes the locking member to move inwardly toward its unlocked position as the moveable wall member 24 is moved from its open position to its closed position. As the moveable wall member 24 continues to move to its closed position and the projections 44 are brought into register with the notch 48 of the stationary wall member 26, the spring member 34 urges the locking member 32 back into its locked position.

Figure 13:
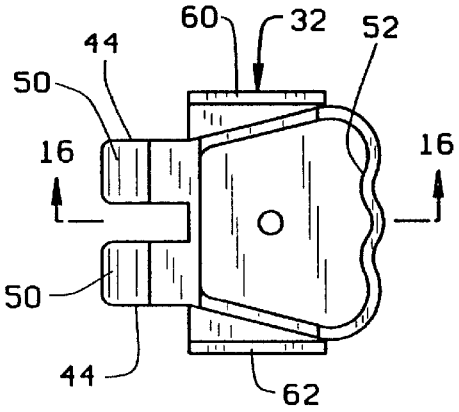
FIG. 13 is a front elevational view of the locking member of the latch assembly of FIG. 1.
Figure 14:
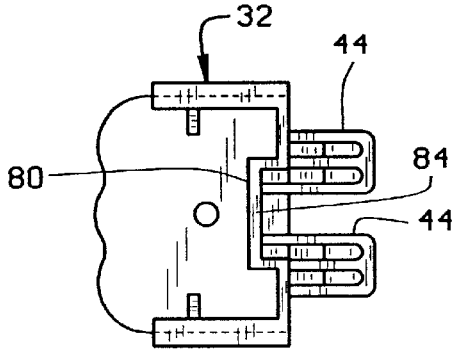
FIG. 14 is a back elevational view of the locking member.

As shown in FIGS. 2, 13 and 14, the locking portion 32 includes a handle portion 52 shaped for direct engagement by the fingers of a user for moving the locking portion 32 between its locked and unlocked positions. Preferably, the moveable wall member 24 includes a thumb engageable surface 54 (see FIG. 2) which, together with the handle portion 52, permits the user to operate the latch assembly 20 by gripping it between the fingers and thumb.

Figure 6:
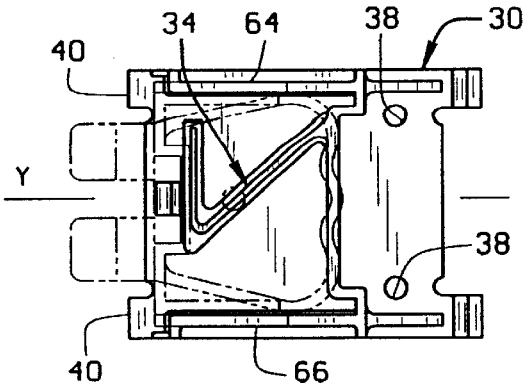
FIG. 6 is a front elevational view of a base portion of the latch assembly of FIG. 1, with a locking member of the latch assembly shown in phantom in a locked position.
Figure 7:
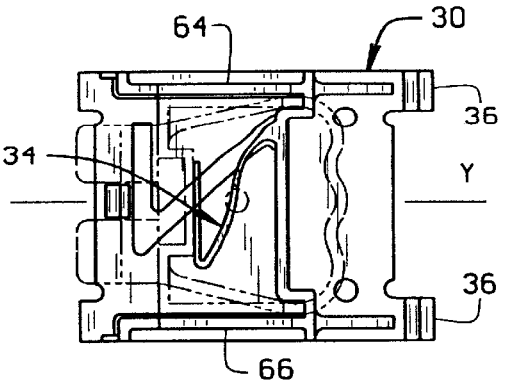
FIG. 7 a front elevational view of the base portion, with the locking member shown in phantom in an unlocked position.
Figure 15:
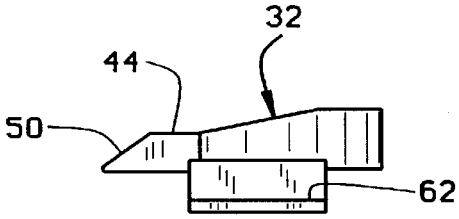
FIG. 15 is a bottom plan view of the locking member.

The latch assembly 20 is adapted to permit the locking member 32 to move linearly relative to the base portion 30 along an axis Y between its locked position (FIG. 6) and unlocked position (FIG. 7). Preferably, the base portion 30 and the locking member 32 are connected to one another in a manner so that movement of the locking member 32 relative to the base portion 30 is substantially limited to linear movement. As best shown in FIGS. 13 and 15, the locking member 32 includes a pair of parallel flanges 60 and 62 at opposite side edges of the locking member. As best shown in FIG. 11, the base portion 30 includes upstanding portions 64 and 66 which define a pair of parallel channels 68 and 70 sized to receive the flanges 60 and 62 in a manner to permit sliding movement of the locking member 32 relative to the base portion 30. Therefore, the manner in which the base portion 30 and the locking member 32 are connected to one another limits the moveability of the locking member 32 relative to the base portion 30 substantially to one degree of freedom.

The spring member 34 is adapted for engaging both the base portion 30 and the locking member 32 in a manner for urging the locking member 32 toward its locked position. The spring member 34 comprises a resilient portion 72 and an engaging portion 74. The resilient portion 72 preferably extends from a proximal end 76 of the spring member 34 to a distal end 78. The engaging portion 74 of the spring member 34 is at the distal end 78. As best shown in FIGS. 6, 8 and 9, in the preferred embodiment of the present invention, the resilient portion 72 of the spring member 34 is an elongate member, and is connected to the engaging portion 74 at one end of the engaging portion 74 so that the resilient portion 72 extends generally obliquely (diagonally) relative to the axis Y. In other words, at least a part of the resilient portion 72 is not parallel to the axis Y. However, the resilient portion 72 is preferably contained in a plane generally parallel to the plane of the moveable wall member 24 and flexes only within that plane. Although the resilient portion 72 is shown as having a straight shape, it is to be understood that it could have other shapes without departing from the scope of the present invention.

The spring member 34 is substantially enclosed by the locking member 32 and base portion 30. Therefore, the construction of the latch assembly 20 is such that the user's hand is shielded from the spring member 34 throughout the entire range of movement of the locking member 32 between its locked and unlocked positions, and is protected from possible injury which might result if, for example, the spring member 34 were to fracture during use.

The proximal end 76 of the spring member 34 is connected to the base portion 30. In the preferred embodiment of the present invention and, as best shown in FIGS. 6 through 9, the spring member 34 and the base portion 30 are of a monolithic piece. In other words, they constitute a single piece.

Figure 16:
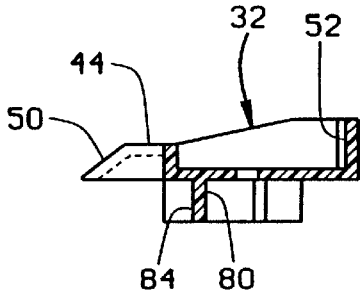
FIG. 16 is a cross-sectional view of the locking member taken along the plane of line 16—16 in FIG. 13.

The engaging portion 74 of the spring member 34 is moveable between a first position (FIG. 6) and a second position (FIG. 7) relative to the proximal end 76. As best shown in FIGS. 14 and 16, the locking member 32 includes an engaging surface 80 adapted for engagement with the engaging portion 74 of the spring member 34 in a manner so that movement of the locking member 32 from its locked position toward its unlocked position effectuates movement of the engaging portion 74 of the spring member 34 from the first position toward the second position. The engaging portion 74 of the spring member 34 is generally planar and remains substantially flush against the engaging surface 80 of the locking member 32 as the locking member 32 moves between its locked and unlocked positions.

It should be understood that, although the preferred embodiment has been described with the spring member 34 and the base portion 30 being of a monolithic piece, it is to be understood that the spring member 34 and the locking member could instead be of a monolithic construction without departing from the scope of the present invention as hereinafter claimed. It should also be understood that, although the preferred embodiment has been described with the base portion 30 being an separate component which is mounted to the moveable wall member 24, the same function could be accomplished with the base portion 30 and the moveable wall member 24 being of a monolithic piece. Additionally, it should be understood that the base portion 30 could be fixed to the stationary wall member 26, rather than to the moveable wall member 24, without departing from the scope of the present invention.

As shown in FIGS. 6, 7, 8 and 12, the base portion 30 includes a stop 82 and, as shown in FIGS. 14 and 16, the locking member 32 includes an abutting portion 84. The abutting portion 84 is engageable with the stop 82 in a manner for preventing the locking member 32 from being urged by the spring member 34 beyond its locked position (i.e., to the left as viewed in FIG. 6). The base portion 30 also includes a ramped surface 86 generally adjacent the stop 82. The ramped surface 86 is adapted to engage the abutting portion 84 of the locking member 32 in a manner to cause relative deflection between the base portion 30 and the locking member 32 to permit the abutting portion 84 to pass over the stop 82 as the locking member 32 is connected to the base portion 30.

A method of the present invention for making a latch assembly comprises the steps of forming a base portion 30, forming a locking member 32, and forming a spring member 34. Preferably, the base portion 30, locking member 32 and spring member 34 are injection molded from acetal or some other suitable polymeric materials. The steps of forming the base portion 30 and forming the spring member 34 are performed substantially simultaneously. Preferably, the base portion 30 and the spring member 34 are formed together of a single monolithic piece.

For convenience and consistency, the phrase "wall member" has been used throughout the specification and claims in describing the function of the present invention. However, it should be understood that the phrase "wall member" refers to any structure serving to divide, support, protect, separate or enclose an area or field, such as a side or surface of a container. And although the latch assembly of the present invention is shown and described as being used with a collapsible storage bin, the latch assembly 20 could also be used in other types of storage containers, or in drawers, fences, doors, or any other environment where it is necessary to lock a first wall member and a second wall member to one another to prevent relative movement therebetween.

As various changes could be made without departing from the scope of the invention, it is intended that all matter contained in the above description or shown in the accompanying drawings shall be interpreted as illustrative and not in a limiting sense.

What is claimed is:

1. A latch having a base member and a sliding locking member, comprising:

said base member having a pair of parallel channels and said locking member having a pair of flanges to be correspondingly received in said pair of channels for guiding sliding movement of said locking member relative to said base member back and forth along a sliding direction into and out of a locking position;

said base member having a spring member projecting from said base member between said channels including an engaging portion and a resilient portion extending between said engaging portion and said base, said base member and said spring member being of one monolithic piece; and said locking member having an engaging surface for engaging said engagement portion of said spring member to resiliently urge projections of said locking member to extend outwardly from said base into said locking position, wherein said engaging portion of said spring member is substantially perpendicular to the sliding direction of said locking member during the sliding movement of said locking member and said resilient portion extends at an angle between said engaging portion and said base member.

2. A latch according to claim 1, further including said locking member having an abutting portion and said base member having a stop that that engages said abutting portion to limit the extent of sliding movement of said locking member in the direction extending outwardly from said base.

3. A latch according to claim 2, wherein said base has a ramped surface adjacent said stop that engages said abutting portion of said locking member during assembly of the latch when said locking member is engaged in the guided sliding movement relative to said base opposite to the direction extending outwardly from said base.

4. A latch according to claim 3, wherein said pair of channels, said spring member and said base are all of one monolithic piece.

5. The latch of claim 1, mounted on a wall member, and further comprising said base member having first and second mounting tabs on opposite ends of said base in combination with mounting holes that secure said base to a wall member.

6. A latch according to claim 1, wherein said locking member includes a handle portion.

7. A latch according to claim 6, wherein said pair of flanges, said abutting portion said engaging surface and said handle portion of said locking member are all parts of one monolithic piece.

8. A latch mounted on wall members of a container for latching the wall members having a base member and a sliding locking member that are movable relative to one another, comprising:

said base member being secured to one of said wall members and having a pair of parallel channels;

said locking member having a pair of flanges that are correspondingly received in said pair of channels for guiding sliding movement of said locking member relative to said base member back and forth along a sliding direction into and out of a locking position in which said wall members are secured to one another;

said base member having a spring member projecting from said base member between said channels including an engaging portion and a resilient portion extending between said engaging portion and said base, said base member and said spring member being of one monolithic piece; and said locking member having projections that are received in a recess of the other of said wall members and said locking member having an engaging surface for engaging said engagement portion of said spring member to resiliently urge said projections to extend outwardly from said base into said recess in said locking position to latch said wall members to one another, wherein said engaging portion of said spring member is substantially perpendicular to the sliding direction of said locking member during the sliding movement of said locking member and said resilient portion extends at an angle between said engaging portion and said base member.

9. A latch for latching wall members of a container according to claim 8, further including said locking member having an abutting portion and said base member having a stop that that engages said abutting portion to limit the extent of sliding movement of said locking member in the direction extending outwardly from said base.

10. A latch for latching wall members of a container according to claim 9, wherein said pair of channels and said spring member of said base are all of one monolithic piece.

11. A latch for latching wall members of a container according to claim 8, wherein said pair of flanges, said abutting portion and said engaging surface of said locking member are all parts of one monolithic piece.

12. A latch for latching wall members of a container according to claim 8, further comprising said base member having first and second mounting tabs on opposite ends of said base that are received in corresponding recesses in said one wall member and mounting holes that receive pins that project from said one wall member that secure said base to said one wall member.

13. A latch having a base member and a sliding locking member, comprising:

one of said base member and said locking member having a pair of parallel channels and the other one of said base member and said locking member having a pair of flanges to be correspondingly received in said pair of channels for guiding sliding movement of said locking member relative to said base member back and forth along a sliding direction into and out of a locking position; and one of said base member and said locking member having a spring member projecting from said one of said base member and said locking member between said channels and flanges, said spring member including an engaging portion and a resilient portion extending between said engaging portion and said base member, said base member and said spring member being of one monolithic piece; and the other one of said base member and said locking member having an engaging surface for engaging said engagement portion of said spring member to resiliently urge said locking member to extend outwardly from said base into said locking position, wherein said engaging portion of said spring member is substantially perpendicular to the sliding direction of said locking member during the sliding movement of said locking member and said resilient portion extends at an angle between said engaging portion and said base member.

14. A latch according to claim 13, further including said other one of said base member and said locking member having an abutting portion and one of said base member and said locking member having a stop that that engages said abutting portion to limit the extent of sliding movement of said locking member in the direction extending outwardly from said base.

15. A latch according to claim 14, wherein one of said base member and said locking member has a ramped surface adjacent said stop that engages said abutting portion of said other one of said base member and said locking member during assembly of the latch in a direction opposite to the direction extending outwardly from said base.

16. The latch of claim 13, mounted on a wall member, and further comprising said base member having first and second mounting tabs on opposite ends of said base in combination with mounting holes that secure said base to a wall member.

17. A latch according to claim 13, wherein said other one of said base member and said locking member includes a handle portion.

* * * * *